US006866355B2

(12) United States Patent
Aruga et al.

(10) Patent No.: US 6,866,355 B2
(45) Date of Patent: Mar. 15, 2005

(54) INK JET RECORDING APPARATUS, AND METHOD OF SUPPLYING INK TO SUB-TANK OF THE INK JET RECORDING APPARATUS

(75) Inventors: Yoshiharu Aruga, Nagano (JP); Atsushi Kobayashi, Nagano (JP); Toshio Kumagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/024,643

(22) Filed: Dec. 21, 2001

(65) Prior Publication Data

US 2002/0085050 A1 Jul. 4, 2002

(30) Foreign Application Priority Data

Dec. 21, 2000 (JP) ..... P.2000-389223

(51) Int. Cl.[7] ..... B41J 2/175
(52) U.S. Cl. ..... 347/7
(58) Field of Search ..... 347/7, 23, 85, 347/86; 141/198; 137/453, 454

(56) References Cited

U.S. PATENT DOCUMENTS 3,967,549 A * 7/1976 Thompson et al. ..... 347/125
4,178,595 A * 12/1979 Jinnai et al. ..... 347/7
4,432,005 A * 2/1984 Duffield et al. ..... 347/86
4,466,284 A * 8/1984 Dumery ..... 73/313
4,737,801 A * 4/1988 Ichihashi et al. ..... 347/85
5,712,667 A * 1/1998 Sato ..... 347/7
6,155,664 A * 12/2000 Cook ..... 347/7
6,290,343 B1 * 9/2001 Lewis et al. ..... 347/85
6,334,658 B1 * 1/2002 Suzuki ..... 347/7

FOREIGN PATENT DOCUMENTS

EP 841 173 A2 * 5/1998 ..... B41J/2/175
EP 1 097 814 A2 * 5/2001 ..... B41J/2/175

* cited by examiner

*Primary Examiner*—Lamson Nguyen
*Assistant Examiner*—Blaise Mouttet
(74) *Attorney, Agent, or Firm*—Sughrue Mion, PLLC

(57) ABSTRACT

Ink from an ink cartridge is supplied along an ink supply tube to a sub-tank mounted on a carriage. Provided for the sub-tank is an ink level detector constituted by a float member on which a permanent magnet is mounted, and Hall devices. Further, a ink consumption counter is also included for calculating the quantity of ink ejected or discharged by a recording head. When a low ink state is detected by the ink level detector and when the value held by the ink consumption counter has reached a predetermined ink quantity total, the supply of ink from the ink cartridge to the sub-tank is initiated.

11 Claims, 9 Drawing Sheets

INK JET RECORDING APPARATUS, AND METHOD OF SUPPLYING INK TO SUB-TANK OF THE INK JET RECORDING APPARATUS

BACKGROUND OF THE INVENTION

The present invention relates to an ink jet recording apparatus wherein sub-tanks for supplying ink to a recording head are mounted on a carriage, and relates in particular to an ink jet recording apparatus that can control, within an appropriate range, the quantity of ink retained in each sub-tank and to a method of supplying ink the sub-tanks of the ink jet recording apparatus.

A related ink jet recording apparatus of a serial printing type is provided with: an ink jet recording head, which is mounted on a carriage and is moved in a width direction of a recording sheet; and a paper feeding unit, for moving the recording sheet in a direction perpendicular to the width direction in which the recording head is moved. Based on printing data, the ink jet recording apparatus, when printing, ejects ink droplets from the recording head onto a recording sheet.

For this type of recording apparatus, which is provided for office or for professional use, ink cartridges having large capacities must be provided so that they can cope with the printing of a comparatively large quantity of data. Therefore, a recording apparatus wherein main tanks serving as ink cartridges are loaded into cartridge holders arranged on the main body of the apparatus, for example, is provided.

In a thus arranged recording apparatus, sub-tanks are located on a carriage on which a recording head is mounted, and ink in the sub-tanks which supply ink to the recording head is replenished via ink tubes extending from the main tanks to the sub-tanks.

Recently, the demand has increased for large recording apparatuses that can be used for the printing of data on large sheets of paper and that provide extended scanning distances for carriages. For such a recording apparatus, in order to improve throughput, number of nozzles formed in the recording head is attempt to be increased. Further, also in order to improve throughput, such a recording apparatus is requested that during the performance of the printing process, the main tanks can, as needed, concurrently replenish the ink in the sub-tanks mounted on the recording head carriage, so that a stable supply of ink for the recording head can be provided by the sub-tanks.

In this recording apparatus, the length of an ink tube used to connect a main tank and a sub-tank is naturally extended. Further, as is described above, since an increased number of nozzles are formed in the recording head, ink consumption is increased, the dynamic pressure on the ink passing through each ink tube communicating with a main tank and a sub-tank is increased. Accordingly, as a technical object, the ink supply available for replenishing the sub-tanks falls short of that which is actually required.

For the resolution of this object, the present inventor proposes an appropriate recording apparatus. In this apparatus, by introducing air under pressure into a main tank, the flow of ink from the main tank to a corresponding sub-tank is forcibly generated, and a required and adequate quantity of ink is supplied to replenish the sub-tank. In this case, ink level detector must be arranged in the sub-tank in order to constantly maintain the volume of the ink stored therein within a predetermined range. By using result off the detection by the ink level detector (hereinafter also referred to as surface detector), an ink supply valve that is located along an ink path leading from a main tank to a sub-tank is controlled to be opened and closed. This configuration has also been proposed by the present inventor.

Preferably, an ink level detector includes: a permanent magnet attached to a float member stored in a sub-tank; and a Hall device which is positioned on the side wall of the sub-tank to detect and measure the magnetic force of the permanent magnet. With this arrangement, a low ink state in which the quantity of ink retained in the sub-tank is less than a predetermined value, or a full ink state, in which the quantity of ink retained in the sub-tank is equal to or greater than the predetermined value, can be detected by utilizing the output of the Hall device.

When the ink level detector detects the low ink state, the ink supply valve located along the ink path leading from the main tank to the sub-tank is opened, so that replenishment of the ink in the sub-tank can be effected. When the ink level detector detects a full ink state, the ink supply valve is closed, thereby halting the replenishment process. By repeatedly performing this process, the volume of the ink retained in a sub-tank can be maintained within a predetermined range.

The ink level detector is employed to supply or halt the supply of ink to the sub-tank, the following process is repeated, when the low ink state is detected, the ink is immediately supplied to the sub-tank, and when the full ink state is detected, the supply of ink to the sub-tank is halted. That is, since, during printing, a low ink state can be detected and the replenishment of ink effected after only a small quantity of ink has been consumed, and since a full ink state can be detected after only a small quantity of ink has been supplied, the on and off supply of ink is rapidly and frequently, cyclically repeated.

As one example problem that may arise when a recording apparatus is thus arranged, as the carriage reciprocates, rippling of the ink in the sub-tanks mounted on the carriage may occur and may result in the available ink volumes being erroneously detected, an unintended and undesirable condition that may also be encountered when for some other reason vibration of the recording apparatus occurs. Therefore, if due to this effect low ink states are erroneously detected, even though the sub-tanks are actually filled, ink replenishment process is performed, and it may cause the sub-tanks to overflow, and may in some cases precipitously produce a critical problem by causing ink to leak from the sub-tanks.

FIGS. 9 and 10 are specific diagrams showing an example in which the ink level detector has erroneously and unpropitiously detected the ink level in a sub-tank. First, in the example in FIG. 9, one Hall device has been provided to detect the strength of the magnetic field of a permanent magnet attached to a float member. With this arrangement, when only a small quantity of ink remains in the sub-tank, the strength of the magnetic force acting on the Hall device is very weak. In this case, as is indicated in region (1) in FIG. 9, the Hall device is OFF, identifying a low ink state, and the operation for supplying ink to the sub-tank is performed.

As the ink supply operation raises the level of the ink in the sub-tank, the float member is accordingly raised, until a predetermined strength is attained by the magnetic force of the permanent magnet to the Hall device and renders the Hall device ON, thereby identifying a full ink state, which in FIG. 9 is indicated by a shaded region. When the full ink state is identified, the supply of ink to the sub-tank is halted. After which, if rippling of the ink in the sub-tank occurs, as is described above, due to the reciprocation of the carriage during printing, or as the result of other vibrations, the detector may detects region (2) shown in FIG. 9.

In this case, since the magnetic force acting on the Hall device is reduced, the Hall device is rendered OFF, erroneously detecting a low ink state. Therefore, re-supply of ink to the sub-tank is performed, and an excessive quantity of Ink flows into the sub-tank. Therefore, since the Hall device maintains to identify OFF state, ink leaks from the sub-tank, thereby producing a critical problem.

To eliminate this problem, two Hall devices may be provided in the direction in which the permanent magnet moves (vertically). This arrangement is shown in FIG. 10. As is pictured in FIG. 10A, the magnetic force detection regions of the upper and lower Hall devices are overlapped. Region U is defined so that the upper Hall device is rendered ON indicated, and the region L is defined so that wherein the lower Hall device is rendered ON indicated. With this arrangement, the ink level in the sub-tank can be detected for four states, upper OFF/lower OFF, upper OFF/lower ON, upper ON/lower ON and upper ON/lower OFF, in consonance with the combined outputs of the upper and lower Hall devices.

However, because of variances in the magnetic detection sensitivity exhibited by the Hall devices, and variances due to assembly errors in the distances between the permanent magnet and the Hall devices, the magnetic detection regions of the upper and lower Hall devices may not overlap, as is shown in FIG. 10B. In the state shown in FIG. 10B, a region (3), whereat both Hall devices are rendered OFF, is generated between the magnetic detection regions of the Hall devices, which are depicted as shaded portions.

Therefore, in a full ink state has been detected, since printing, and reciprocation of the carriage, or other vibration sources, causes rippling of the ink in the sub-tank, the region (3) is generated and a low ink state is erroneously detected. In this case, since ink is supplied to the sub-tank due to the error, a sub-tank overflow occurs, and the printing must be halted to perform maintenance.

As is described above, when an ink level detector provided with a Hall device and a permanent magnet attached to a float member is employed, the first problem that occurs is that the supply of ink to the sub-tank is frequently repeated, and the second problem that occurs is that vibration causes the quantity of ink in the sub-tank to be erroneously detected.

SUMMARY OF THE INVENTION

To resolve the above technical problems, it is one objective of the present invention to provide an ink jet recording apparatus that can set a satisfactory long interval for the supply of ink to sub-tanks and can thus prevent the erroneous detection of the ink quantities in the sub-tanks, which is caused by a factor such as vibration, and a control method for supplying ink to the sub-tanks of the ink-recording apparatus.

In order to solve the aforesaid object, the invention is characterized by having the following arrangement.

(1) An ink jet recording apparatus comprising;

a recording head mounted on a carriage, the recording head being reciprocally movable in a width direction of a recording sheet; and a sub-tank, for supplying, to the recording head, ink supplied from an ink cartridge, mounted on the carriage with the recording head, the sub-tank including, an ink level detector, for detecting at least a low ink state in which quantity of ink stored in the sub-tank is smaller than a predetermined value, and a full ink state in which the quantity of ink stored in the sub-tank reaches the predetermined value, and an ink consumption counter, for acquiring the total quantity of ink ejected or discharged by the recording head, wherein, when the ink level detector detects the low ink state and the value acquired by the ink consumption counter reaches a predetermined count value, ink is supplied to the sub-tank by the ink cartridge.

(2) The ink jet recording apparatus according to (1), wherein the predetermined count value stored in the ink consumption counter is set equal to or smaller than a value obtained by subtracting the quantity of ink to be ejected by the recording head during one cleaning operation from an effective ink quantity in the sub-tank.

(3) The ink jet recording apparatus according to (1), wherein an ink supply valve is disposed along an ink supply path extending from the ink cartridge to the sub-tank, and when the ink supply valve is opened, ink is supplied to the sub-tank.

(4) The ink jet recording apparatus according to (1), wherein

The ink cartridge stores an ink pack composed of a flexible material in which ink is enclosed, an outer block member of the ink cartridge is airtight, and air compressed by an air compressor is applied to a space defined between the ink pack and the outer block member, and ink from the ink cartridge is supplied to the sub-tank under the compressed air.

(5) The ink jet recording apparatus according to (4), wherein the ink level detector is capable of detecting an overflow state in which the quantity of ink stored is greater than in the full ink state, and when the overflow state is detected, an operation is performed for opening the ink supply valve and for releasing, to the atmosphere, the air compressed by the air compressor.

(6) The ink jet recording apparatus according to (1), wherein the ink level detector for detecting the quantity of ink retained in the sub-tank includes;

a float member, which floats on ink that is supplied to the sub-tank;

a permanent magnet mounted on the float member; and a magnetoelectric element for outputting an electrical signal in response to magnetic force generated by the permanent magnet according to a relative position of a afloat position of the float member and the magnetoelectric element.

(7) The ink jet recording apparatus according to (1), wherein the ink quantity counter obtains the quantity of ink consumed by performing a multiplication process using a coefficient based on the number of ink droplets ejected by the recording head, and by performing a multiplication process, using a coefficient, each time a cleaning operation is performed to suck and discharge ink from the recording head, (8) An ink supply method of controlling supply of ink to a sub-tank of an ink jet recording apparatus which comprises a recording head which is mounted on a carriage and is reciprocally moved across the width of a recording sheet, the sub-tank to which ink from an ink cartridge is supplied and from which ink is supplied to the recording head, an ink level detector for detecting the quantity of ink retained in the sub-tank, and a ink consumption counter for calculating, as a count value, total quantity of ink ejected or discharged by the recording head, the method comprising the steps of:

detecting the quantity of ink stored in the sub-tank by the ink level detector;

referring the count value acquired by the ink consumption counter and determined whether the referred value reaches a predetermined count value when a low ink state in which the quantity of ink stored in the sub-tank is smaller than a predetermined value; and supplying ink from the ink cartridge to the sub-tank when the referred value reaches the predetermined count value.

(9) The method according to (8), wherein when the ink level detector detects, the detecting step, a full ink state in which the quantity of ink reaches the predetermined value, the ink supply halt operation for halting the supply of ink from the ink cartridge to the sub-tank is performed.

(10) The method according to (9), wherein the count value stored in the ink consumption counter is reset when the ink supply halt operation.

According to the ink jet recording apparatus that employs the method for supplying ink to the sub-tank, first, the ink level detector detects the quantity of ink retained in the sub-tank. In this case, because of an above described factor, such as the rippling of ink in the sub-tank or an external vibration, a low ink state may be erroneously detected even though the sub-tank is full of ink.

When the ink level detector detects a low ink state, the ink quantity total held by the ink consumption counter is referred to. The ink consumption counter is reset when the ink level detector has previously detected a full ink state. Therefore, when the ink quantity total held by the ink consumption counter has not reached a predetermined ink quantity total even though the ink level detector has detected a low ink state, it can be assumed that either a very small quantity of ink has been consumed, or an erroneous detection by the ink level detector has occurred. Thus, in this case, the supply of ink to the sub-tank by the ink cartridge is inhibited.

When the ink level detector detects a low ink state and when the ink quantity total held by the ink consumption counter has reached the predetermined ink quantity total, it can be assumed that the quantity of ink retained in the sub-tank has been considerably reduced. Therefore, in this case, the supply of ink to the sub-tank by the ink cartridge is initiated.

Through the exercise of this control, the supply of ink to the sub-tank is initiated when it has been confirmed that a predetermined quantity of the ink in the sub-tank has been consumed. Thus, a problem involving the frequent, repeated resupply of ink from the ink cartridge to the sub-tank can be avoided, and a satisfactorily long interval can be obtained for the supply of ink to the sub-tank.

Since the supply of ink to the sub-tank is controlled, the erroneous detection of the quantity of ink in the sub-tank, which is the result of vibration or another factor, can be prevented, and the quantity of ink in the sub-tank can be constantly maintained within a specific range. Thus, a normal printing operation can be continuously performed.

The predetermined ink quantity total is set for the ink consumption counter to establish a relationship wherein the quantity of ink ejected by the recording head in the printing operation+the ink quantity ejected from the recording head by the flashing operation+the ink quantity discharged from the recording head by one cleaning operation<the effective ink quantity in the sub-tank". Therefore, even when the printing of a predetermined quantity of data, a flushing operation and one cleaning operation are performed following the supply of ink to the sub-tank, the ink in the sub-tank would not be exhausted, so that the problem that would arise were air to enter an empty ink flow path leading from a sub-tank to the recording head can be avoided.

DETAILED DESCRIPTION OF PREFERRED EMBODIMENTS

Figure 1:
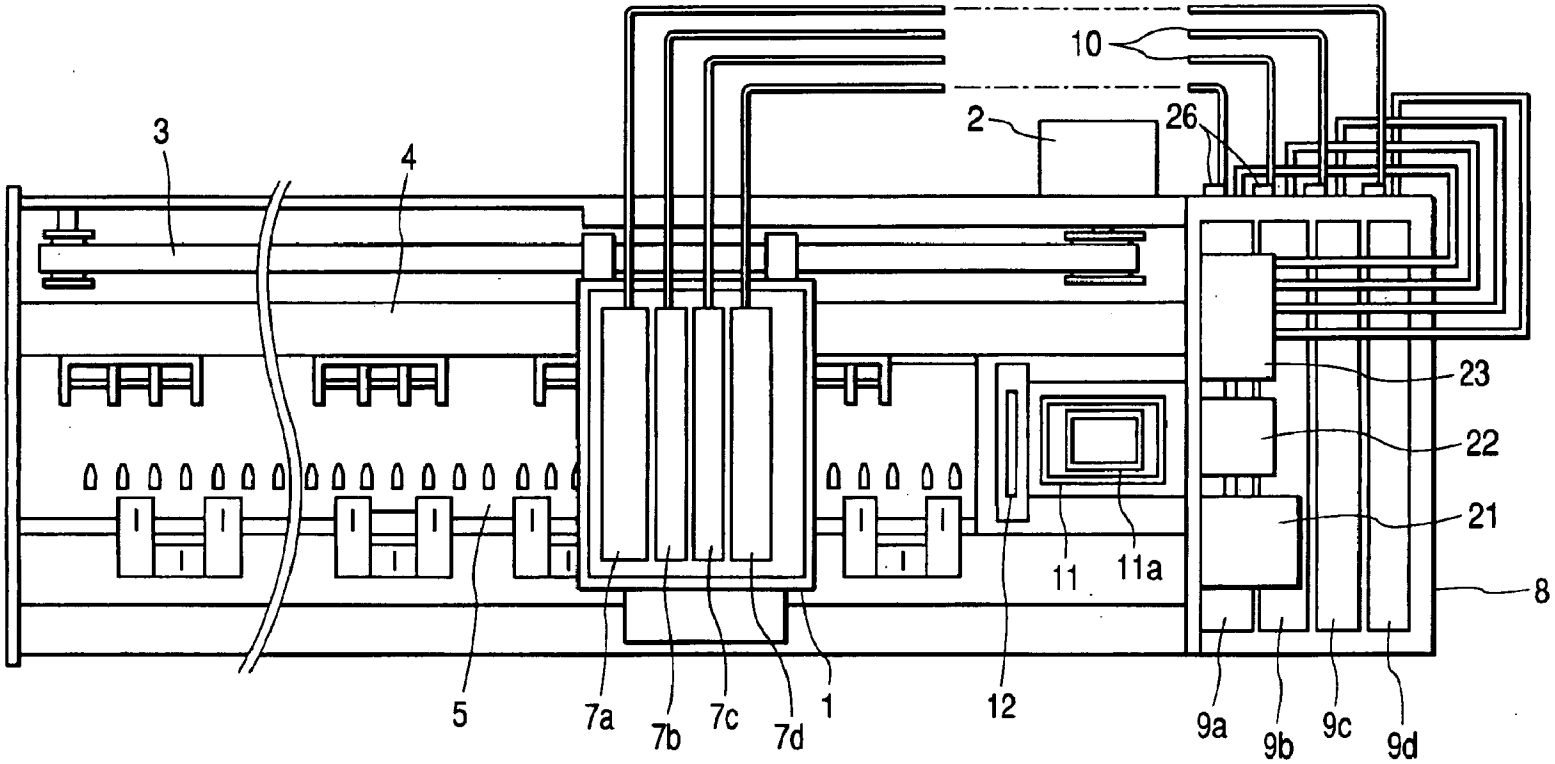
FIG. 1 is a plan view of the basic arrangement of an ink jet recording apparatus according to the present invention.

An ink jet recording apparatus that employs a method of supplying ink to sub-tanks in accordance with the preferred embodiment of the present invention will now be described. FIG. 1 is a top view of the basic configuration of the ink jet recording apparatus. In FIG. 1, a carriage 1 is guided by a scan guide member 4, is driven by a carriage motor 2 through a timing belt 3, and is reciprocally moved in a main scanning direction, that is, the longitudinal direction of a paper feed member 5, i.e., the width direction of a recording sheet. Although not shown in FIG. 1, an ink jet recording head 6, which will be described later, is mounted on the face of the carriage 1 opposite the paper feed member 5.

Sub-tanks 7*a* to 7*d* are mounted on the carriage 1 to supply ink to the recording head 6. In this embodiment, four sub-tanks 7*a* to 7*d* corresponding to inks (e.g., black, yellow, cyan and magenta inks) are prepared for the temporarily storage of these inks therein.

The black and the other colored inks are supplied to the sub-tanks 7*a* to 7*d* from main tanks 9*a* to 9*d*, which are ink cartridges loaded into a cartridge holder 8 at the end of the apparatus and are connected to flexible ink supply tubes 10 constituting ink supply paths.

A capping unit 11 for sealing the nozzle formation surface of the recording head 6 is disposed in a non-printing region (home position) on the route along which the carriage 1 reciprocates. A capping member 11*a* composed of an elastic member, such as rubber, is disposed on the top of the capping unit 11, so that it can be closely attached to the nozzle formation surface of the recording head 6. When the carriage 1 is moved to the home position, the capping member 11*a* is used to close the nozzle formation surface of the recording head 6.

During the recording apparatus is in quiescent time, the capping member 11*a* serves as a lid that seals the nozzle formation surface of the recording head 6 and prevents the nozzle openings from being drying out. One end of the tube of a vacuum pump (tube pump), which will be described later, is connected to the capping member 11*a*, so that, upon the application to the recording head 6 of a negative pressure produced by the vacuum pump, a cleaning operation in which ink is discharged from the recording head 6 is performed.

A wiping member 12 having a strip shape composed of an elastic ember, such as rubber, is disposed in a printing region adjacent to the capping unit 11. As needed, the wiping member 12 is used to clean the nozzle formation means of the recording head 6.

Figure 2:
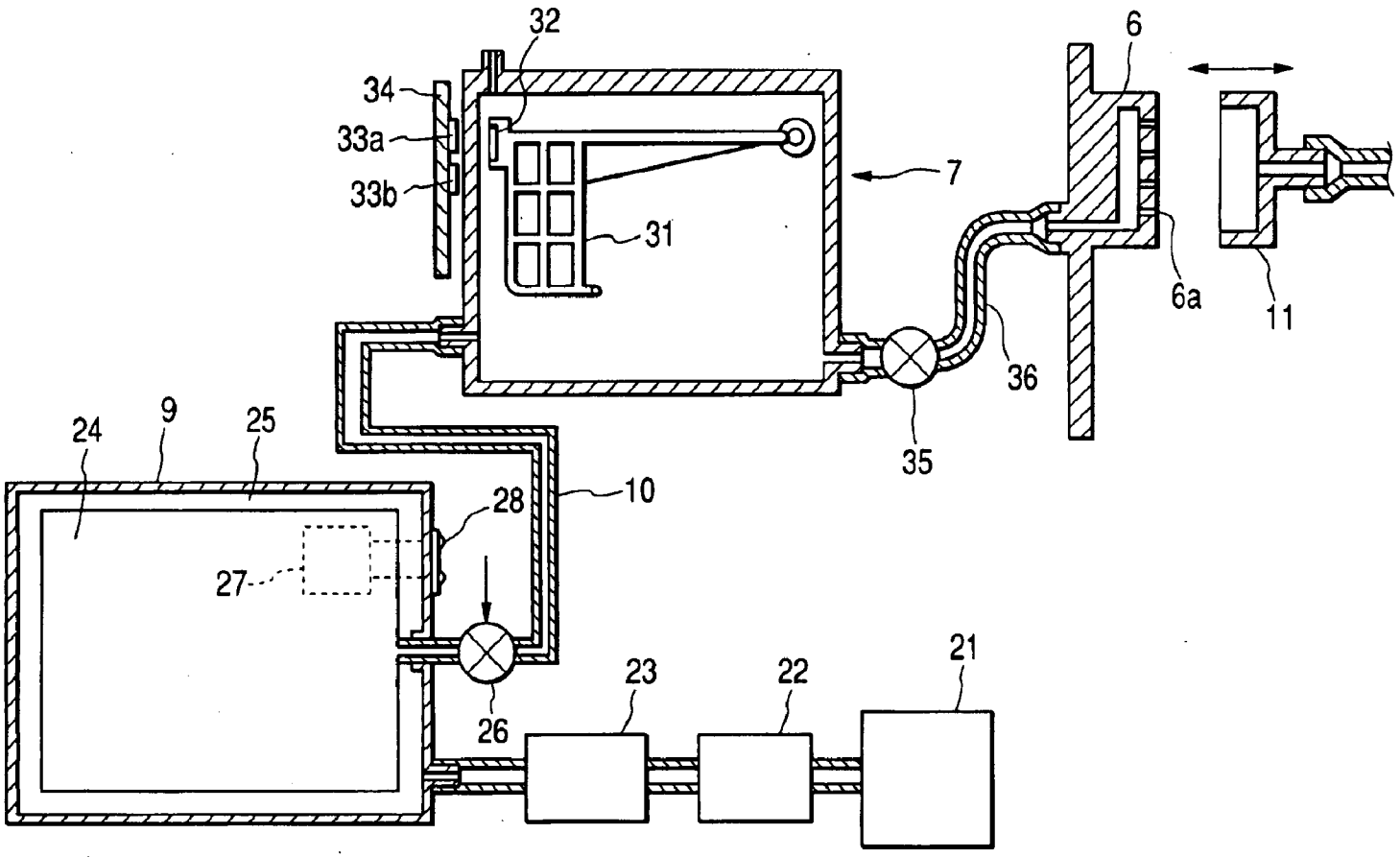
FIG. 2 is a specific diagram showing an ink supply system ranging from an ink cartridge to a recording head.

FIG. 2 is a specific diagram primarily showing the configuration of an ink supply system mounted on the recording apparatus in FIG. 1. The ink supply system will now be described with reference to FIG. 1 and Pig. 2, for which the same reference numerals as in FIG. 1 are used. In FIGS. 1 and 2, air compressed by an air compressor 21 is supplied to a pressure control valve (hereinafter also referred to simply as a regulator) 22 that serves as a relief valve, and via a pressure detector 23, to the main tanks 9*a* to 9*d* (in FIG. 2, these tanks are collectively and simply referred to as the main tank 9; a term that hereinafter may be employed).

In this embodiment, an air flow path leading from the pressure detector 23 is branched so as to apply the compressed air to each main tank 9 loaded in the cartridge holder 8.

When it is determined that due to a specific factor the pressure of the compressed air supplied by the air compressor 21 is excessive, the pressure of the air in the main tanks 9*a* to 9*b* is reduced by the pressure control valve 22, and maintain within a predetermined range. As will be described later, the pressure control valve 22 serves as a pressure regulator that forcibly releases compressed air to the atmosphere based on receiving an appropriate instruction signal.

The pressure detector 23 detects the pressure of the compressed air and controls the operation of the air compressor 21. Specifically, when the pressure of the compressed air exceeds a predetermined level, the pressure detector 23 halts the driving of the air compressor 21, and when the pressure of the compressed air is equal to or less than the predetermined level, the detector 23 drives the air compressor 21. In this manner, a predetermined range is maintained for the pressure of the compressed air in the main tanks 9*a* to 9*d*.

As is shown in the schematic structure in FIG. 2, a case that forms the outer block of the main tank 9 is airtight, and an ink pack 24, composed of flexible material in which ink is enclosed, is stored inside of the case. The space defined between the main tank 9 and the ink pack 24 constitutes a pressure chamber 25, and the compressed air is supplied to this pressure chamber 25 via the pressure detector 23.

With this arrangement, when air pressure acts on the ink packs 24 stored in the main tanks 9*a* to 9*d*, ink flows from the main tanks 9*a* to 9*d* to the sub-tanks 7*a* to 7*d* under a predetermined pressure. A storage device 27, such as an EEPROM, for storing information for the main tank 9 that serves as an ink cartridge, is disposed in a part of the case thereof. As will be described later, data concerning the quantity of ink remaining in the main tank 9 is written in the storage device 27.

A terminal 28 disposed in a part of the main tank 9 is used to read and write information relative to the storage device 27. When the main tank 9 is loaded into the recording apparatus 1, the terminal 28 is electrically connected to the recording apparatus 1 for communication of information concerning the quantity of ink remaining in the main tank 9.

The ink in the main tanks 9*a* to 9*d* is supplied under pressure, via the ink supply valves 26 and along the ink supply tubes 10, to the sub-tanks 7*a* to 7*d* mounted on the carriage 1 (in FIG. 2, these sub-tanks are collectively and simply referred to as the sub-tank 7; a term that hereinafter may be employed).

A detailed explanation will be given later for the structure of the sub-tank 7 in FIG. 2. As the basic structure, a float member 31 is internally arranged in the sub-tank 7 and a permanent magnet 32 is attached to a part of the float member 31. Two magnetoelectric elements 33*a* and 33*b*, which are Hall devices, are vertically attached, in line, to a substrate 34 along the side wall of the sub-tank 7.

With this arrangement, such an output generator is provided that the Hall devices 33*a* and 33*b* utilize the magnetic force generated by the permanent magnet 33, mounted on the float member 31 to generate a variable electric output corresponding to the afloat position of the float member 31 with respect to the Hall devices 33*a* and 33*b*. This out put generator serves to detect the ink quantity in the sub-tank 7 for which the float member 31 is provided, i.e., it provides the ink level detection function.

In this embodiment, based on the combination of outputs of the two Hall devices 33*a* and 33*b*, the ink level detector identifies, in three steps, as the quantity of ink remaining in the sub-tank 7, a low ink state, a full ink state and an overflow state, beginning with a small quantity and proceeding to a large quantity of ink. In this embodiment, an ink consumption calculator is provided for calculating for the sub-tank the quantity of ink that has been consumed, as will be described later. When the ink level detector indicates a low ink state, and when the ink consumption calculator determines that a predetermined quantity or more of ink has been consumed, the ink supply valve 26 is opened. As a result, ink in the pressurized main tank 9 is supplied to the pertinent sub-tank 7 from which the ink has been consumed.

When the ink in the sub-tank 7 reaches a predetermined level, and the ink level detector detects a full ink state, the ink supply valve 26 is closed. By repeating this process, ink from the main tank 9 is continually supplied to the sub-tank 7, and a constant, predetermined quantity of ink is maintained in the sub-tank 7. The ink level detector detects an overflow state when it determines that more ink has been supplied than is required for a full ink state.

As is shown in FIG. 2, ink from each sub-tank 7 is supplied to the recording head 6, through a valve 35 and along a tube 36 connected thereto. Based on print data that is transmitted to the actuator (not shown) of the recording head 6, ink droplets are ejected from nozzle openings 6*a* that are formed in the nozzle formation surface of the recording head 6. A tube, which is connected to the capping unit 11 in FIG. 2, extends to a vacuum pump (tube pump), which will be described later.

Figure 3:
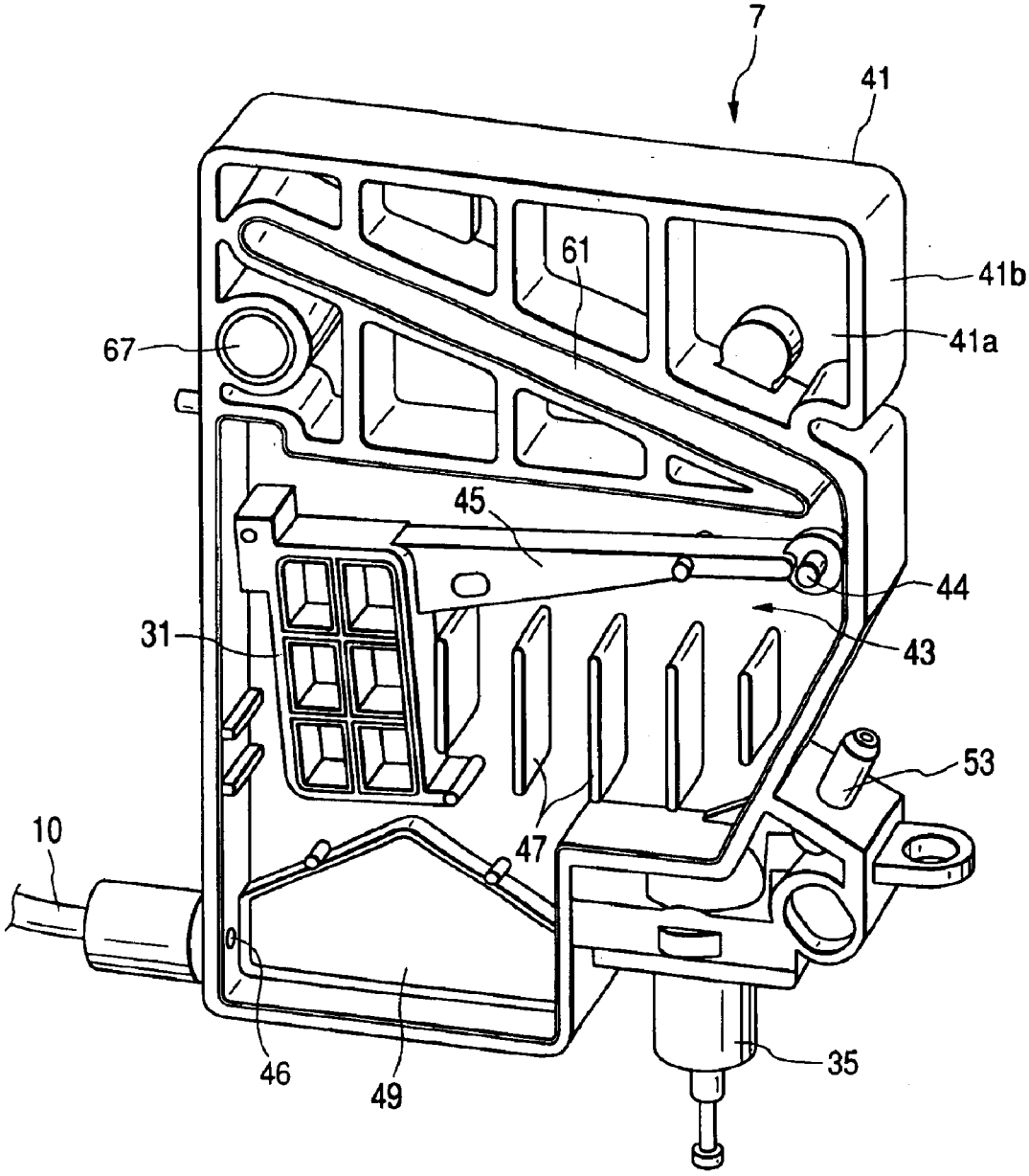
FIG. 3 is a partially cutaway, perspective view of a sub-tank viewed from one plane direction.
Figure 4:
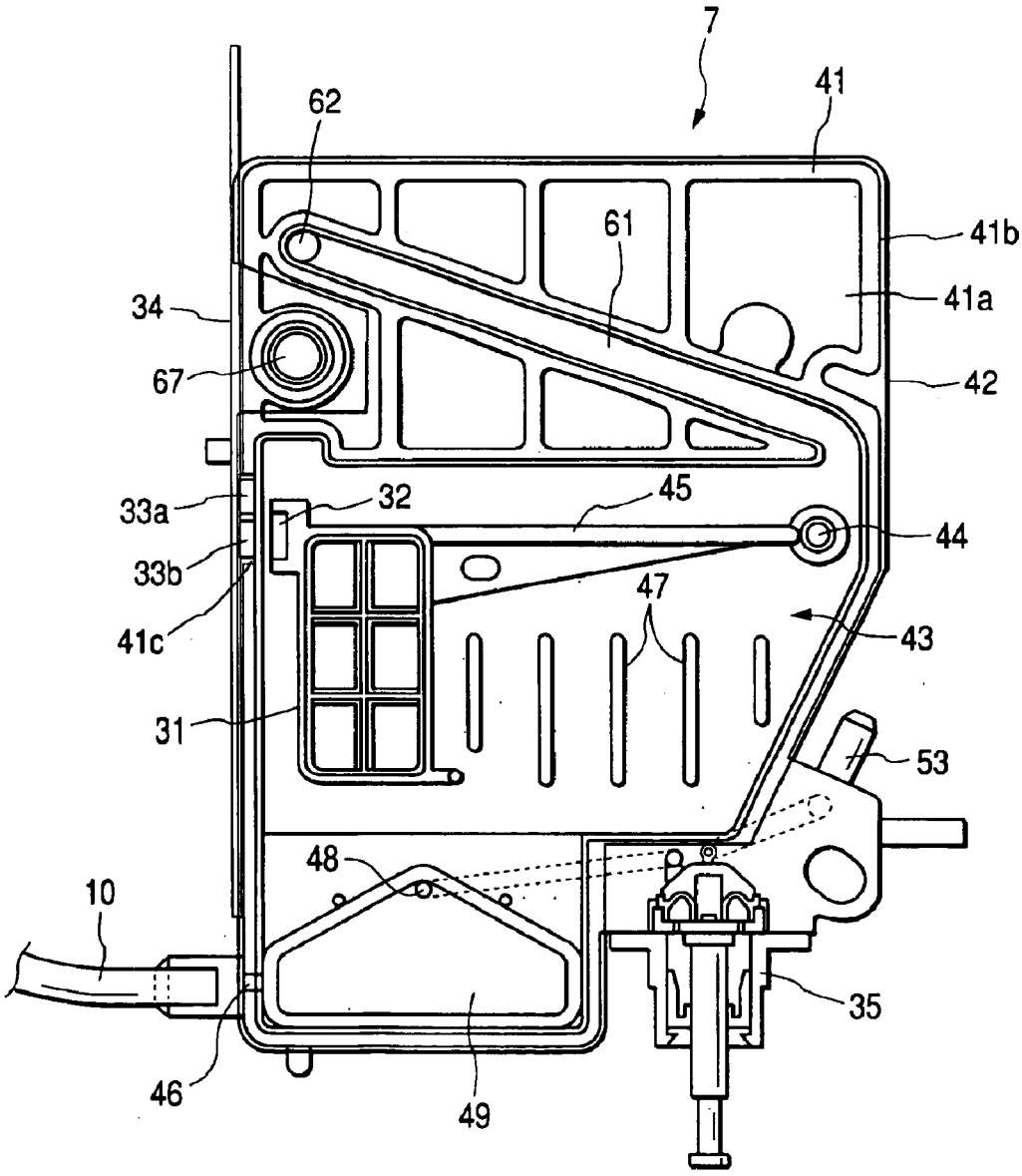
FIG. 4 is a perspective side view of the sub-tank viewed in the same plane direction.

FIG. 3 is a partially-cutaway perspective view of the sub-tank 7 viewed in a direction leading from one face thereof, and FIG. 4 is a side view in the same direction. In FIGS. 3 and 4, previously used component reference numerals are employed to denote corresponding components.

The sub-tank 7 is formed as a substantially rectangular parallelepiped, and overall is flat. The outer block of the sub-tank 7 is a box member 41, integrally formed of one side wall 41*a* and a continuing circumferential sidewall 41*b*. Using thermal fusing means, a film member 42 (see FIG. 4) composed of a transparent resin material is closely attached around the circumference of the opening in the box member 41, and an inside defined by the box member 41 and the film member 42 is an ink retaining space 43.

A support shaft 44 is integrally formed with the box member 41 and projects, toward the ink retaining space 43, from the side wall 41*a* of the box member 41. In the ink retaining space 43, the float member 31 rotates freely at the support shaft 44. In this embodiment, the support shaft 44 is disposed near the horizontal end in the ink retaining space 43, and the float member 31 is integrally formed at the free, movable end of a support arm member 45, which is rotated about the support shaft 44.

As is shown in FIG. 4, the permanent magnet 32 is attached to the free end of the support arm member 45, so that, when the support arm member 45 is positioned substantially horizontally, the magnet 32 is located near the other end of the ink retaining space 43 in the horizontal direction, i.e., is located nearer the Hall devices 33*a* and 33*b* that are mounted on the substrate 34 arranged along the side wall of the sub-tank 7.

An ink supply port 46 is formed at the bottom of the sub-tank 7 in the gravitational direction, i.e., at the bottom of the circumferential side wall 41*b* in this embodiment. Ink from the main tank 9 is supplied to the ink retaining space 43 along the tube 10 connected to the ink supply port 46. Since, as is described above, the ink supply port 46 is formed in the bottom of the sub-tank 7 in the gravitational direction, the ink in the main tank 9 is supplied from the bottom of the ink retaining space 43, so that the generation of ink bubbles at the ink supply inlet is prevented.

Multiple linear rib members 47 are arranged in the portion of the sub-tank 7 except a portion through which the float member 31 and the support arm member 45 move. The rib members 47 are used to suppress the rippling of ink in the sub tank 7 as the carriage is moved. In this embodiment, the rib members 47 are integrally formed with the side wall 41*a* of the box member 41 constituting the sub-tank 7, so that they project inward from the side wall 41*a* into the ink retaining space 43. With these rib members 47, the rippling of ink in the sub-tank 7 can be suppressed to a degree, and the accuracy with which the Hall device detects the quantity of ink retained in the sub-tank 7 can be improved.

As is shown in FIG. 4, an ink outlet port 48 is formed in the sub-tank 7 near the ink supply port 46. A filter member 49, shaped like a pentagon (a home base shape), for trapping foreign substances is positioned so that it covers the ink outlet port 48. Therefore, ink retained in the sub-tank 7 is guided through the filter member 49 to the ink outlet port 48.

The ink discharged through the ink outlet port 48 is transmitted along the reverse face of the side wall 41*a* to the valve 35, which is located under the bottom of the sub-tank 7. Then, the ink is guided along the reverse face of the side wall 41*a* to the connection port 53 for the tube 36 that leads to the recording head 6.

An inclined groove 61 that communicates with the ink retaining space 43 is formed in the upper half portion of the sub-tank 7. An air through hole 62 is formed in the upper end of the groove 61, i.e., high up in the sub-tank 7 in the gravitational direction, and communicates with the reverse face of the side wall 41*a* of the sub-tank 7. It should be noted that on the reverse face of the side wall 41*a* the through hole 62 is closed with a water repellent film that permits the passage of air but prevents the passage of ink.

As is shown in FIG. 4, a recessed portion 41*c* used for positioning the Hall devices 33*a* and 33*b* is formed in the side wall of the sub-tank 7. Since the recessed portion 41*c* is formed in the side wall of the sub-tank 7, that wall is thinner so that the distance between the Hall device 33*a* or 33*b* and the trajectory along which the permanent magnet 32 attached to the float member 31 travels is reduced. As a result, the sensitivity with which the Hall devices 33*a* and 33*b* detect the magnetic force exerted by the permanent magnet 33 is improved, thereby increasing the accuracy of the detection o the quantity off ink by measuring the movement of the float member 31 in the gravitational direction according to the quantity of ink in the sub-tank 7.

A through hole 67 is formed in a part of the sub-tank 7. By using a support shaft (not shown) that passes through the through hole 67 of the sub-tank 7, the sub-tanks 7 can be arranged in parallel so that a sub-tank unit is constituted.

Figure 5:
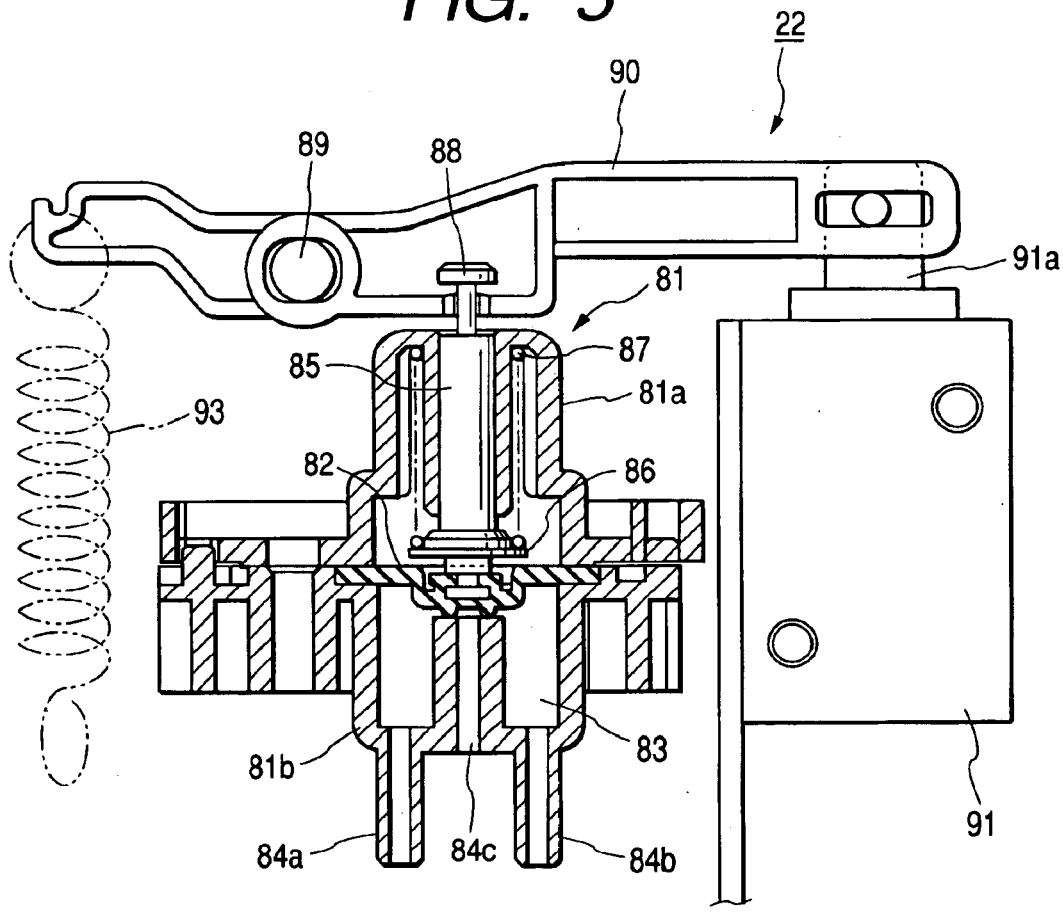
FIG. 5 is a partial cross-sectional view of the state wherein the pressure control valve that is used is a pressure control valve that also serves as a relief valve.
Figure 6:
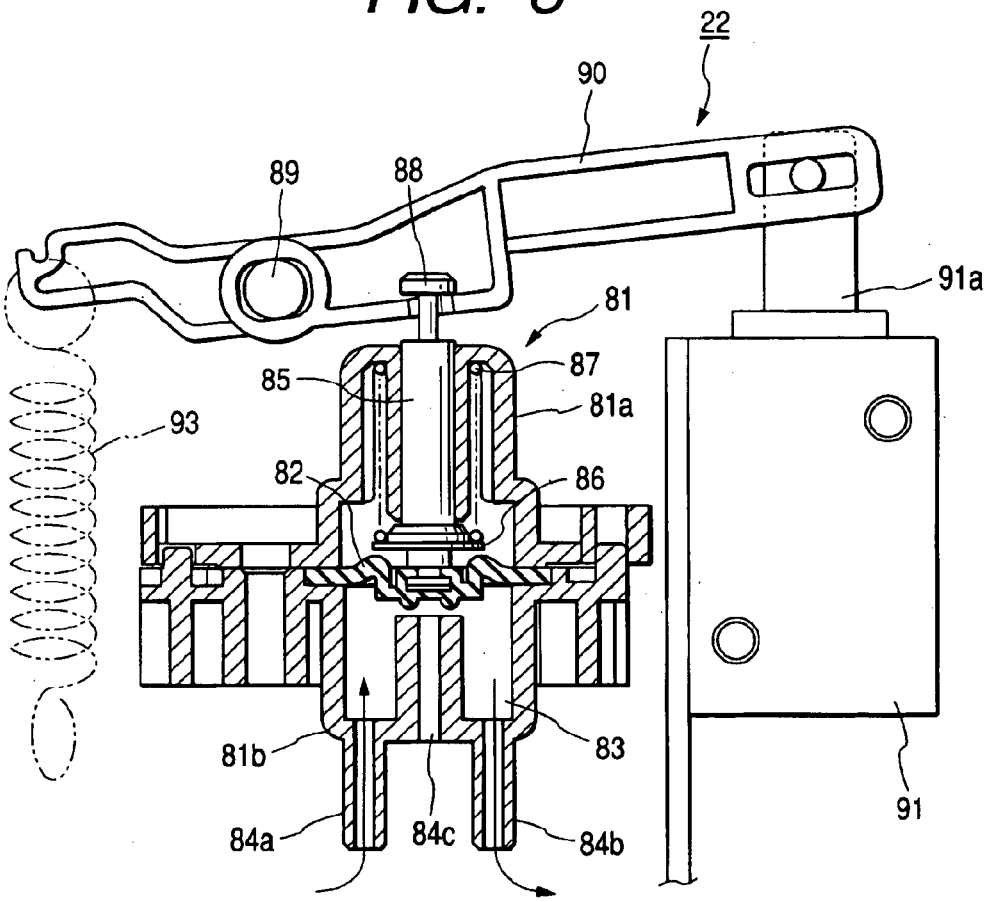
FIG. 6 is a partial cross-sectional view of the air release state obtained by the relief operation.

FIGS. 5 and 6 are partial cross-sectional views of the structure of the pressure control valve 22 that serves as a pressure regulator, with the essential portion cut away. FIG. 5 shows the configuration in a state in which the pressure control valve 22 is functioning normally, and FIG. 6 shows the configuration in a state in which air is being released to relieve pressure.

In FIGS. 5 and 6, a valve unit 81 includes an upper case 81*a* and a lower case 81*b* which define space inside thereof, so that the valve unit 81 is adapted to be divided into upper and lower portions. A diaphragm valve 82 as a valve member is disposed at the junction of the upper case 81*a* and the lower case 81*b*. The diaphragm valve 82 is a rubber disk, and its circumferential edge is held between the upper case 81*a* and the lower case 81*b*. The internal space defined by the lower case 81*b* is formed as an airtight air chamber 83.

A pair of connection pipes 84*a* and 84*b*, which communicate with the air chamber 83, are formed in the lower case 81*b*. These connection pipes 84*a* and 84*b* are connected to the air paths extending from the air compressor 21 to the main tanks 9 as the ink cartridges. Therefore, compressed air from the air compressor 21 passes along the path indicated by the arrow in FIG. 6 through the air chamber 83 to the pressure detector 23 and the main tanks 9 that will be described later. An air through hole 84*c* is formed in the center of the lower case 81*b* so that an opening end of the air through hole 84*c* located inside the air chamber 83 is adapted to be abutted to the approximately center of the diaphragm valve 82.

A drive shaft 85, which moves vertically, is disposed on the upper case 81*a*, and the top face of the diaphragm valve 82 is supported by the lower end of the drive shaft 85. An annular spring seat 86 is fitted over the drive shaft 85 and a coil spring (compression spring) 87 is located between the spring seat 86 and the upper space in the upper case 81*a*. The center of the diaphragm valve 82 is compressed by the spring member 87 so that it covers the opening end of the through hole 84*c*.

An engagement head 88, disposed at the upper end of the drive shaft 85, is engaged with a drive lever 90, which is supported by a shaft 89, in the middle, between one end of the drive lever 90 and the shaft 89. An operating rod 91*a* of an electromagnetic plunger 91 is coupled with the one end of the drive lever 90 so that the driving force generated by the electromagnetic plunger 91 can be applied to the operating rod 91*a*. One end of a spring member, i.e., a tension spring 93, is attached to the other end of the drive lever 90 adjacent to the shaft 89, and rotates the drive lever 90 to the left at the shaft 89.

With this arrangement, when the electromagnetic plunger 91 is electrified, as is shown in FIG. 5, the one end of the drive lever 90 is pulled down against the urging force of the tension spring 93. Therefore, the engagement head 88, which is attached to the drive shaft 85 of the valve unit 81, floats free of the drive lever 90, while the urging force of the spring member 87 and the flexible force of the diaphragm valve 82 close the air through hole 84*c*.

In the valve close state, when the air compressor 21 is driven, and when the pressure in the air pressure chamber 83 exceeds a predetermined value, i.e., when the pressure exceeds an injection-valve closing pressure applied by the urging force of the spring member 87 and the flexible force of the diaphragm valve 82, the diaphragm valve 82 is raised by the air pressure, so that the through hole 84*c* is opened. Therefore, the compressed air is forcefully discharged from the air chamber 83 through the air through hole 84*c*, and the pressure is released.

When the air pressure is reduced to a predetermined value, the valve closing operation is again performed by the urging force of the spring member 87 and the flexible force of the diaphragm valve 82. As a result, the pressure along the air path extending from the air compressor 21 to the main tank 9 is controlled within a predetermined range. As is described above, in a state in which the electromagnetic plunger 91 is operated, when the air pressure exceeds a predetermined value in the conductive state in FIG. 5, the diaphragm valve 82 is repetitively opened and closed and functions as a pressure control valve. Since this pressure control function is provided, a problem can be avoided that arises when the air pressurization control malfunctions, and an abnormally high air pressure is applied to and ruptures the ink pack in the main tank.

On the other hand, when the supply of power to the electromagnetic plunger 91 is halted, as is shown in FIG. 6, the drive lever 90 is rotated in the counterclockwise by the tractive force applied by the tension spring 93, so as to pull the drive shaft 85 in the valve unit 81 upward against the urging force applied by the spring member 87 and the flexible force of the diaphragm valve 82 in the valve unit 81. Therefore, compressed air is forcibly discharged from the air chamber 83 at the through hole 84*c*, and an air released state is obtained.

According to the arrangement in FIGS. 5 and 6, since an air released state is obtained as in FIG. 6 when the supply of power to the electromagnetic plunger 91 is halted, this state is immediately provided when the recording apparatus is powered off and no further power is supplied to the electromagnetic plunger 91. Therefore, in the OFF state, when the recording apparatus is not powered on, the compressed air in the main tank is automatically released. Therefore, by halting the operation of the recording apparatus, the problem presented by the leakage of ink induced by compressed air retained in the main tank 9 can be avoided.

Figure 7:
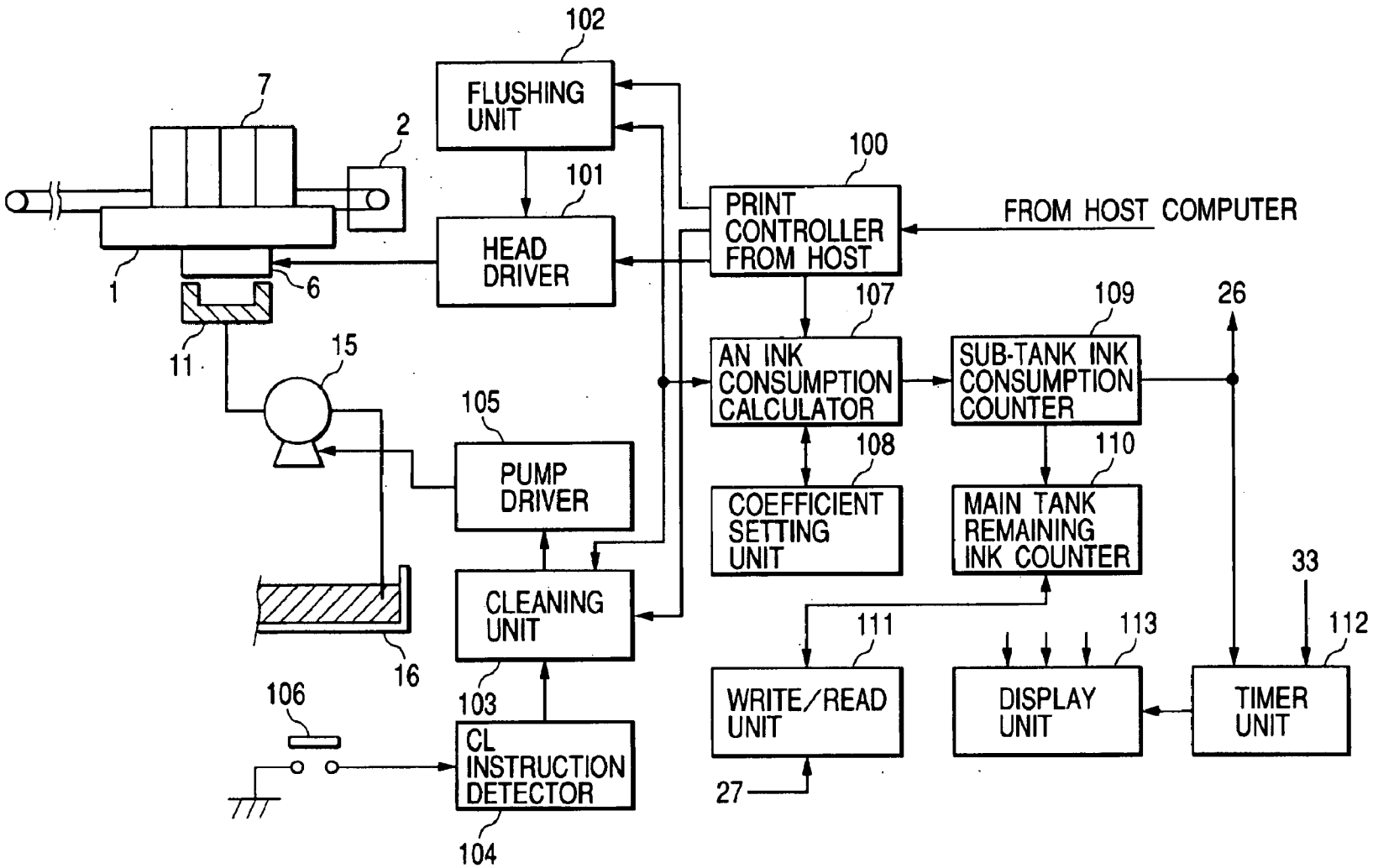
FIG. 7 is a block diagram showing a control circuit that constitutes a part of the means for supplying ink to the sub-tank that implements the method of the invention.

FIG. 7 is a diagram showing an example control circuit constituting a part of the means which is provided to supply ink to the sub-tank and implements the method of the invention. In FIG. 7, previously used component reference numerals are again employed to denote corresponding components, and no further explanation for them will be given. As is shown in FIG. 7, a vacuum pump 15 is connected to the capping unit 6, and on its discharge side is connected to a waste water tank 16.

In FIG. 7, a print controller 100 generates bit map data based on print data received from a host computer, and a head driver 101 generates a drive signal for the ejection of ink droplets from the recording head 6 mounted on the carriage 1 based on the bit map data. In addition to the drive signal based on the print data, the head driver 101 outputs a drive signal for a flushing operation upon receiving a flushing instruction signal from a flushing controller 102.

Upon receiving a control signal from cleaning instruction detector 104, a cleaning controller 103 controls a pump driver 105 for driving the vacuum pump 15. And when a cleaning instruction switch 106 arranged on the console panel of the recording apparatus is manipulated, the cleaning instruction detector 104 is operated and a manual cleaning operation is performed. In addition, the cleaning controller is constituted to receive a control signal from the print controller 100. Upon receiving the control signal from the print controller 100, the cleaning controller 103 performs the timer cleaning operation to permit the pump driver 105 to drive the vacuum pump 15 for every predetermined time.

The control signal is supplied to the ink consumption calculator 107 from the print controller 100, the flushing controller 102 and the cleaning controller 103. The ink consumption calculator 107 has a function of calculating the quantity of ink that has been consumed for each sub-tank 7. For this purpose, the ink consumption calculator 107 receives the following three of data. The first data concerns the number of ink droplets that are ejected by the recording head 6 based on the print data and is transmitted from the print controller 100. The second data concerns the number of ink droplets ejected during the flushing operation performed by the recording head 6 and is transmitted from the flushing controller 102. the third data concerns the ink discharging process in each cleaning operation for discharging ink from the recording head and is transmitted from the cleaning controller 103.

Upon receiving these data, based on the number of ink droplets ejected during the printing operation or the flushing operation by the recording head 6, or based on the ink discharge process performed for each cleaning operation, the ink consumption calculator 107 accesses coefficient setting unit 108, and performs the multiplication of a corresponding coefficient to calculate for each sub-tank the quantity of ink that has been consumed.

The quantity of ink consumed that is thus obtained for each sub-tank 7 is transmitted to an ink consumption counter 109, and is added (count up) as ink quantity total. Then, as is described above, when the ink level detector, which includes the Hall devices 33*a* and 33*b*, for detecting the quantity of ink in the sub-tank 7 detects a low ink state and when the value held by the ink consumption counter 109 reaches a predetermined ink quantity total, it is assumed that the ink in the sub-tank 7 is in the low ink state. Therefore, the ink supply valve 26 is opened and ink from the main tank 9 is supplied to the sub-tank 7.

When the ink is supplied and it is determined that the quantity of ink retained in the sub-tank 7 reaches a predetermined value (a full ink state) by detecting the electric output by the Hall devices 33*a* and 33*b*, the ink supply valve 26 is closed, as is described above, and at the same time, the ink consumption counter 109 for the sub-tank 7 is reset.

The ink consumption counter 109 for the sub-tank 7 is constituted so as to transmit, to a remaining ink counter 110 for the main tank 9, information concerning the quantity of ink held in the sub-tank 7. Data on the quantity of ink remaining in the main tank 9, which is stored in the storage device 27 mounted in the loaded main tank 9, is set in advance by a write/read unit 111 in the remaining ink counter 110 for the main tank 9.

The latest numerical value, stored in the ink consumption counter 109 for the sub-tank 7 immediately before the counter 109 is reset, is transmitted to the remaining ink counter 110 for the main tank 9. The numerical value stored in the ink consumption counter 109 for the sub-tank is subtracted from the numerical value indicating the quantity of ink remaining in the main tank. Therefore, the numerical value of the remaining ink counter 110 for the main tank is decremented as ink is consumed, and the resultant value data is written, 6 using the write/read unit 111, in the storage device 27 mounted in the main tank 9. Therefore, when data is read from the storage device mounted in the ink cartridge that serves as the main tank 9, the quantity of ink remaining in the cartridge can be immediately determined.

A control signal for opening or closing the ink supply valve 26 is transmitted to a timer unit 112 by the consumed ink counter 109 for the sub-tank 7. The timer unit 112 starts a time count at the same time as the ink supply valve 26 is opened. When the level state detected by the Hall devices 33*a* and 33*b* still indicates a low ink state, even though a set time has elapsed, it can be assumed that the main tank 9 is in the ink exhausted (ink-out) state, or that for some reason an obstacle has appeared in the ink supply system. In this case, an error message is displayed on a display unit 113, as will be described later.

Figure 8:
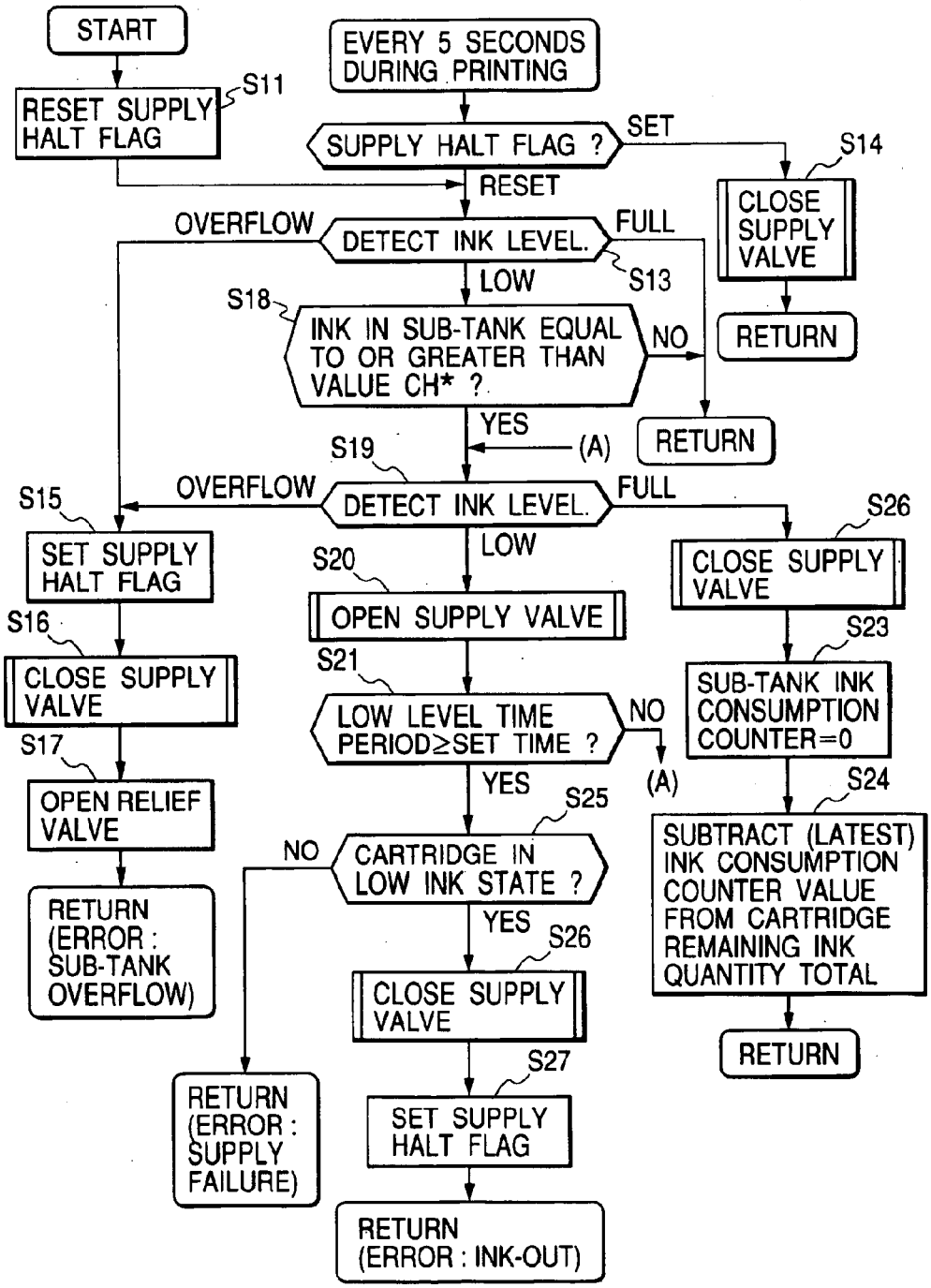
FIG. 8 is a flowchart showing the control routine for the method of the invention for supplying ink to the sub-tank.
Figure 9:
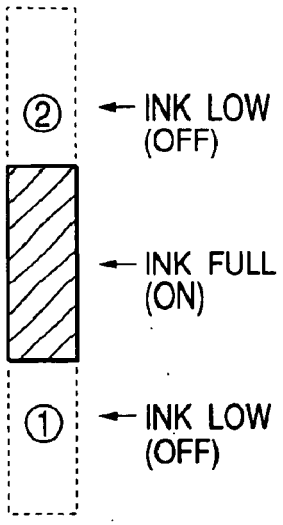
FIG. 9 is a specific diagram showing an example wherein ink level detector erroneously detects the quantity of ink when one magnetoelectric element is provided.
Figure 10A:
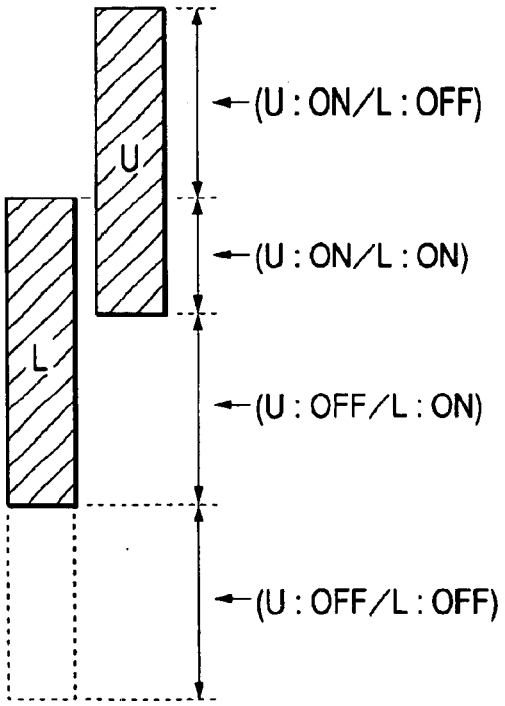
FIGS. 10A and 10B are specific diagrams showing an example wherein the ink level detector erroneously detects the quantity of ink when two magnetoelectric elements are provided.
Figure 10B:
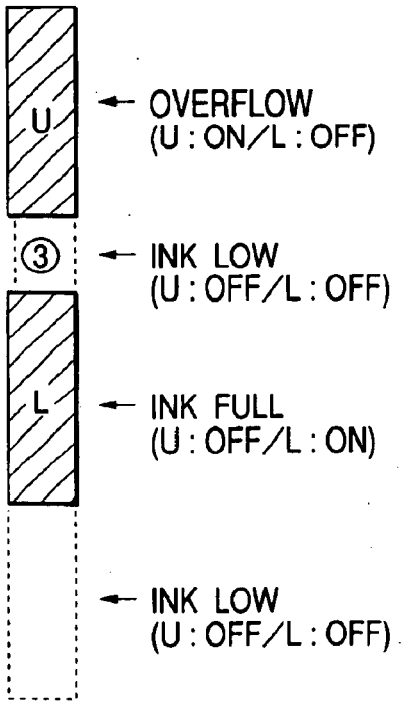

FIG. 8 is a flowchart showing the control routine for the above arranged recording apparatus for employing the method for supplying ink to the sub-tank 7. This control routine is performed independently for each main tank 9, which is an ink cartridge, and for a corresponding sub-tank 7. The control routine starts when the recording apparatus is powered on, or every five seconds, for example, during printing, in order to determine whether supply of ink from the main tank 9 to the sub-tank 7 is necessary.

First, when the recording apparatus is powered on, at step S11 a supply halt flag is reset. That is, when the supply halt flag is reset, the supply of ink to the sub-tank 7 is prepared. Then, at step S13, the level of the ink is determined, i.e., the quantity of ink in the sub-tank 7 is determined by referring the combination of outputs of the two Hall devices 33*a* and 33*b* constituting the ink level detector.

During the printing, as is described above, the process at step S12 is performed every five seconds to determine whether the supply halt flag is set or reset. When the supply halt flag is set, the ink supply to the sub-tank 7 is not performed, and at step S14, the supply valve 26 is closed. Thereafter, program control returns. When it is determined at step S12 that the supply halt flag is reset, at step S13 the level of ink in the sub-tank 7 is detected.

At step S13, the three states described above, i.e., the ink overflow state, the full ink state and the low ink state, are identified. When the overflow state is detected, program control advances to step S15 to set the supply halt flag. Then, at step S16 the supply valve 26 is closed, and at step S17, the relief valve 22 is opened. That is, in this case, with reference to FIG. 6, the supply of power to the electromagnetic plunger 91 is halted, and the valve unit 81 is opened by the tension spring 93. As a result, the air compressed by the air compressor 21 is released to the atmosphere.

Under this control, the supply of the compressed air to each main tank 9 is halted, and the supply of ink to each sub-tank 7 is disabled. Further, an error message indicating that maintenance is required is displayed on the display unit 113.

When a full ink state is detected at step S13, the supply of ink to the sub-tank 7 is not required, and program control returns. When a low ink state is detected at step S13, program control advances to step S18, and the value held by the consumed ink counter 109 determines whether for the sub-tank the quantity of ink consumed is equal to or greater than "Ch*".

"Ch*" is a predetermined value set as a parameter, and corresponds to "sum of the quantity of ink ejected by the recording head 6 for printing and the quantity of ink ejected by the recording head during a flushing operation". The quantity of ink is so controlled that, even if the quantity of ink used for ejection or discharging is subtracted from the value indicating a full ink state and when the quantity of ink used for cleaning is further subtracted from the resultant value, the level of ink is higher than the effective quantity of ink in the sub-tank. In this embodiment, the "effective ink level in the sub-tank 7, i.e. effective quantity of ink" is set higher than the horizontal line that runs through the ink outlet port 48 formed in the sub-tank 7 in FIG. 4.

That is, "Ch*" is set equal to or smaller than "the effective quantity of ink in the sub-tank 7 minus the quantity of ink discharged by the recording head 7 for one cleaning operation". When "Ch*" is so set, the sub-tank 7 is set to the full ink state, and even when, before the next ink supply, ink is consumed by printing or flushing and further, the cleaning operation is performed once, the level of the ink in the sub-tank 7 is maintained higher than the horizontal level that runs across the ink outlet port 48 of the sub-tank 7. Thus, when ink is consumed in the above described manner, the ink in the sub-tank 7 is not exhausted nor is it less than the effective quantity of ink, and a problem that arises when air enters because the ink flow path from the sub-tank 7 to the recording head 6 has been emptied can be avoided.

When it is determined that the value held by the ink consumption counter 109 does not reach the predetermined value (No), program control returns. When it is determined that the value held by the ink consumption counter 109 has reached the predetermined value (Yes), program control advances to the routine for supplying ink to the sub-tank 7.

In this embodiment, as is described above, when the level detection result at step S13 is a low ink state and the value held by the ink consumption counter 109 has reached the predetermined value, the supply of ink to the sub-tank 7 is performed. Since this condition of a logical product is provided, the interval for the supply of ink to the sub-tank 7 can be extended, and the erroneous detection of the quantity of ink in the sub-tank 7 due to a factor such as vibration can be prevented. Therefore, the quantity of ink retained in the sub-tank 7 can be precisely managed.

Specifically, if the apparatus is so constituted that only the level detection result at step S13 is employed to perform the supply of ink to the sub-tank 7, the supply of ink is begun in a low ink state. Then, since a full ink state is detected only after a short period of time, the ink supply is halted, and further, after only another short time, the low ink state is detected. Therefore, the supply of ink must be frequently repeated. However, in the embodiment of the present invention as described above, since the supply of ink is performed when a low ink state is detected and it is determined that the ink in the sub-tank has been consumed and has reached a predetermined value, the supply of ink is repeated following a satisfactory time interval.

On the other hand, if the apparatus is so constituted that only the value held by the ink consumption counter 10 at step S18 is employed to perform the supply of ink to the sub-tank 7, a little error has to occur in the calculation performed by the ink consumption calculator 107 in FIG. 7. Therefore, an error is acquired by the repetitive resetting and counting performed by the ink consumption counter 109, and the quantity of ink in the sub-tank 7 is gradually increased until it enters the overflow state, or in the worst case, ink leaks from the sub-tank 7. Alternatively, a problem may occur in that by gradually reducing the level of ink the sub-tank 7 is exhausted and air enters the ink flow path that communicates with the recording head 6.

As is described above, when a "Yes" decision is obtained at step S18, program control advances to the routine for supplying ink to the sub-tank 7. At step S19, level detection is performed, as ink is supplied to monitor the level of ink in the sub-tank. At this time, in most cases, the level detection result is a low ink state, and at step S20 the supply valve 26 is opened and ink from the main tank 9 is supplied to the sub-tank 7.

At step S21, a check is performed to determine whether the period of time at the low level has reached a set time. That is, the elapsed time from which the supply valve 26 was opened at step S20 is calculated by the timer unit 112. At this time, the period of time at the low level has not reached the set time, and a "No" decision is obtained. Therefore, program control returns via the loop (A) in FIG. 8 to step S19, and the ink supply to the sub-tank 7 is monitored. That is, the ink supply routine from step S19 to step S21 is repeated. when it is determined at step S19 that the sub-tank 7 is full, program control is shifted to step S22.

At step S22, the supply valve 26 is closed, at step S23, the ink consumption counter 109 for the sub-tank 7 is reset, and at step S24, the latest value held by the ink consumption counter 209 is subtracted from the value held by the cartridge remaining ink counter 110. Then, program control thereafter returns. For this subtraction, as is described above, the latest ink quantity total held by the ink consumption counter 109 for the sub-tank 7 immediately before it is reset is transmitted to the remaining ink counter 110 for the main tank 9, and is subtracted from the ink quantity total that indicates the quantity of ink remaining in the main tank 9. In this manner, the quantity of ink remaining in the main tank 9 can be managed.

As is described above, when the overflow state is detected while program control is shifted via the loop (A) and the supply of ink to the sub-tank 7 is monitored, program control enters the previously described routine beginning with step S15. The supply of the compressed air to each main tank 9 is halted, and the supply of ink to each sub-tank 7 is disabled. Then, an error message indicating that maintenance of the recording apparatus is required is displayed on the display unit 113.

When it is determined at step S21 that the period of time at the low level has exceeded the set time, it is assumed that ink has not been satisfactorily supplied even when the predetermined time set for supplying ink to the sub-tank 7 has been reached. Therefore, program control advances to step S25, and the quantity of ink remaining in the ink cartridge is examined. In this case, the value held by the remaining ink counter 110 for the main tank 9 is examined. When a low ink state is detected (Yes), it is determined that there is a shortage of ink in the ink cartridge, at step S26 the supply valve 26 is closed, and at step S27 the supply halt flag is set. In this case, it is preferable that an error message is displayed on the display unit 113 indicating that the ink in the ink cartridge has been exhausted.

When it is determined at step S25 that the value held by the remaining ink counter 110 for the main tank 9 does not indicate a low ink state (No), it can be assumed that an obstacle has appeared in the ink supply system and that ink can not be supplied to the sub-tank 7. In this case, it is preferable that an error message be displayed on the display unit 13 for an ink supply failure.

In this embodiment, the ink supply valve is disposed along the ink supply path extending from the ink cartridge to the sub-tank, and as the supply valve is opened or closed, the ink has been intermittently supplied to the sub-tank. However, the present invention need not be applied only for the above described configuration, and an ink transmission pump may be disposed along the ink supply path leading from the ink cartridge to the sub-tank.

In the embodiment, compressed air has been used to exert pressure on the ink cartridge, and upon the application of this pressure, ink from the ink cartridge has been supplied to the sub-tank. However, the present invention can also be applied for a recording apparatus wherein, for example, an ink cartridge is located at a high position in the gravitational direction, so that pressure head difference is used to supply ink to a sub-tank.

As is apparent from this description, according to the ink jet recording apparatus that employs the method of the invention for supplying ink to the sub-tank, when a low ink state is detected by the ink level detector and when the value held by the ink consumption counter reaches the predetermined ink quantity total, ink from the ink cartridge is supplied to the sub-tank. With this arrangement, the repetitive operation by which ink is frequently supplied to the sub-tank can be avoided. Further, the erroneous detection of the quantity of ink in the sub-tank, which is caused by a factor such as vibration, can also be prevented. Thus, it is ensured that the quantity of ink in the sub-tank is constantly controlled within a predetermined range, and that normal printing can continuously be performed.

What is claimed is:

1. An ink jet recording apparatus comprising:

a recording head mounted on a carriage, the recording head being reciprocally movable in a width direction of a recording sheet; and a sub-tank for supplying ink to the recording head from an ink cartridge, wherein the sub-tank is mounted on the carriage with the recording head, the sub-tank comprising:

an ink level detector, configured to detect at least a low ink state in which quantity of ink stored in the sub-tank is smaller than a predetermined value, and a full ink state in which the quantity of ink stored in the sub-tank reaches the predetermined value, and an ink consumption counter, configured to acquire the total quantity of ink ejected or discharged by the recording head, wherein the ink level detector and the ink consumption counter are configured to operate simultaneously, and a controller for supplying ink to the subtank as a direct consequence of the ink level detecting the low ink state and the value acquired by the ink consumption counter reaching a predetermined count value.

2. The ink jet recording apparatus according to claim 1, wherein the predetermined count value stored in the ink consumption counter is set equal to or smaller than a value obtained by subtracting the quantity of ink to be ejected by the recording head during one cleaning operation from an effective ink quantity in the sub-tank.

3. The ink jet recording apparatus according to claim 1, wherein an ink supply valve is disposed along an ink supply path extending from the ink cartridge to the sub-tank, and when the ink supply valve is opened, ink is supplied to the sub-tank.

4. The ink jet recording apparatus according to claim 1, wherein the ink cartridge stores an ink pack composed of a flexible material in which ink is enclosed, an outer block member of the ink cartridge is airtight, and air compressed by an air compressor is applied to a space defined between the ink pack and the outer block member, and ink from the ink cartridge is supplied to the sub-tank under the compressed air.

5. The ink jet recording apparatus according to claim 1, wherein the ink level detector for detecting the quantity of ink retained in the sub-tank includes:

a float member, which floats on ink that is supplied to the sub-tank;

a permanent magnet mounted on the float member; and a magnetoelectric element for outputting an electrical signal in response to magnetic force generated by the permanent magnet according to a relative position of a float position of the float member and the magnetoelectric element.

6. The ink jet recording apparatus according to claim 5, wherein the magnetoelectric element is positioned on a side wall of the sub-tank and a recessed portion is formed in the side wall of the sub-tank where the magnetoelectric element is positioned, so that the distance between the magnetoelectric element and a trajectory, along which the permanent magnet attached on the float member travels, is reduced.

7. The ink jet recording apparatus according to claim 1, wherein the ink quantity counter obtains the quantity of ink consumed by performing a multiplication process using a coefficient based on the number of ink droplets ejected by the recording head, and by performing a multiplication process, using a coefficient, each time a cleaning operation is performed to suck and discharge ink from the recording head.

8. An ink jet recording apparatus comprising:

a recording head mounted on a carriage, the recording head being reciprocally movable in a width direction of a recording sheet; and a sub-tank for supplying ink to the recording head from an ink cartridge, wherein the sub-tank is mounted on the carriage with the recording head, the sub-tank comprising:

an ink level detector, for detecting at least a low ink state in which quantity of ink stored in the sub-tank is smaller than a predetermined value, and a full ink state in which the quantity of ink stored in the sub-tank reaches the predetermined value, and an ink consumption counter, for acquiring the total quantity of ink ejected or discharged by the recording head, wherein the ink level detector and the ink consumption counter operate simultaneously, and a controller for supplying ink to the sub-tank as a direct consequence of the ink level detector detecting the low ink state and the value acquired by the ink consumption reaching a predetermined count value, wherein the ink cartridge stores an ink pack composed of a flexible material in which ink is enclosed, wherein an outer block member of the ink cartridge is airtight, wherein air compressed by an air compressor is applied to a space defined between the ink pack and the outer block member, and ink from the ink cartridge is supplied to the sub-tank under the compressed air, wherein the ink level detector is capable of detecting an overflow state in which the quantity of ink stored is greater than in the full ink state, and when the overflow state is detected, an operation is performed for opening the ink supply valve and for releasing, to the atmosphere, the air compressed by the air compressor.

9. An ink supply method of controlling supply of ink to a sub-tank of an ink jet recording apparatus which comprises a recording head which is mounted on a carriage and is reciprocally moved across the width of a recording sheet, the sub-tank to which ink from an ink cartridge is supplied and from which ink is supplied to the recording head, an ink level detector for detecting the quantity of ink retained in the sub-tank, and a ink consumption counter for calculating, as a count value, total quantity of ink ejected or discharged by the recording head, the method comprising the steps of:

detecting the quantity of ink stored in the sub-tank by the ink level detector;

referring to the count value acquired by the ink consumption counter and determining whether the referred value reaches a predetermined count value where a low ink state in which the quantity of ink stored in the sub-tank is smaller than a predetermined value;

supplying ink from the ink cartridge to the sub-tank as a direct consequence of the ink level detector detecting the low ink state and the referred value reaching the predetermined count value, wherein, the detecting and referring steps are performed simultaneously.

10. The method according to claim 9, wherein when the ink level detector detects a full ink state in which the quantity of ink reaches the predetermined value, an ink supply halt operation for halting the supply of ink from the ink cartridge to the sub-tank is performed.

11. The method according to claim 10, wherein the count value stored in the ink consumption counter is reset when the ink supply halt operation is performed.

* * * * *